US010307771B2

(12) United States Patent
Otani et al.

(10) Patent No.: US 10,307,771 B2
(45) Date of Patent: Jun. 4, 2019

(54) LANCE NOZZLE AND EXCESS SPRAYED COATING REMOVAL DEVICE INCLUDING THE SAME

(71) Applicant: SUGINO MACHINE LIMITED, Uozu, Toyama Prefecture (JP)

(72) Inventors: Shunji Otani, Toyama (JP); Hajime Sakurai, Toyama (JP); Masaaki Sugimura, Namerikawa (JP)

(73) Assignee: SUGINO MACHINE LIMITED, Uozu (JP)

( * ) Notice: Subject to any disclaimer, the term of this patent is extended or adjusted under 35 U.S.C. 154(b) by 243 days.

(21) Appl. No.: 15/180,490

(22) Filed: Jun. 13, 2016

(65) Prior Publication Data

US 2017/0209878 A1 Jul. 27, 2017

(30) Foreign Application Priority Data

Jan. 27, 2016 (JP) ..... 2016-013639

(51) Int. Cl.

| | |
|---|---|
| ***B05B 1/10*** | (2006.01) |
| ***B05B 1/20*** | (2006.01) |
| ***B05B 1/28*** | (2006.01) |
| ***B05B 3/02*** | (2006.01) |
| ***B08B 3/02*** | (2006.01) |
| ***B08B 9/00*** | (2006.01) |
| ***B05B 12/16*** | (2018.01) |
| ***B05B 12/32*** | (2018.01) |
| ***B05B 13/06*** | (2006.01) |

(52) U.S. Cl.

CPC ..... *B05B 1/10* (2013.01); *B05B 1/20* (2013.01); *B05B 1/28* (2013.01); *B05B 3/027* (2013.01); *B05B 12/16* (2018.02); *B05B 12/32* (2018.02); *B05B 13/0636* (2013.01); *B08B 3/02* (2013.01); *B08B 9/00* (2013.01)

(58) Field of Classification Search

CPC ..... B08B 9/00; B08B 3/02; B05B 13/0636; B05B 1/28

See application file for complete search history.

(56) References Cited

U.S. PATENT DOCUMENTS

2008/0017159 A1 1/2008 Bohnheio et al.

FOREIGN PATENT DOCUMENTS

| | | | | |
|---|---|---|---|---|
| DE | 19621869 A1 | | 12/1997 | |
| DE | 19924141 A1 | * | 12/2000 | ..... B24C 3/32 |
| JP | 2008-303439 A | | 12/2008 | |
| JP | 2011-230118 A | | 11/2011 | |
| JP | 2015-058479 A | | 3/2015 | |

* cited by examiner

*Primary Examiner* — Spencer E Bell
(74) *Attorney, Agent, or Firm* — Oliff PLC

(57) ABSTRACT

A lance nozzle injecting fluid includes a shaft body, a first nozzle hole, and a second nozzle hole. The shaft body internally includes a flow path of the fluid. The first nozzle hole is disposed on a leading end side of the shaft body, and generates a first jet in a first injecting direction inclining to a base end side of the shaft body with respect to a direction perpendicular to an axial direction of the shaft body. The second nozzle hole is disposed on a base end side of the first nozzle hole in the shaft body, and generates a second jet in a second injecting direction inclining to a leading end side of the shaft body with respect to a direction perpendicular to an axial direction of the shaft body.

3 Claims, 8 Drawing Sheets

LANCE NOZZLE AND EXCESS SPRAYED COATING REMOVAL DEVICE INCLUDING THE SAME

BACKGROUND

1. Field of the Invention

The present invention relates to a lance nozzle and an excess sprayed coating removal device including the same that are appropriate for, for example, removing an excess sprayed coating adhering inside a crank chamber of an engine.

2. Description of the Related Art

There have been known aluminum cylinder blocks in which an iron-based sprayed coating is formed in a cylinder bore. When the sprayed coating is formed in the cylinder bore, the sprayed coating also adheres to the interior of a crank chamber. Since the sprayed coating adhering to the interior of the crank chamber is unnecessary, it is necessary to remove the sprayed coating (hereinafter referred to as the excess sprayed coating). A method for removing excess sprayed coatings adhering to the interior of the crank chamber by using the water jet from a water injection nozzle is disclosed for example in Japanese Unexamined Patent Application Publication No. 2008-303439.

The water injection nozzle disclosed in the Japanese Unexamined Patent Application Publication No. 2008-303439 is equipped with a first injection port of low-pressure injection, the first injection port provided on the leading end side thereof and a second injection port of high-pressure injection. This water injection nozzle is configured such that a water curtain is formed by the low-pressure injection from the first injection port and the excess sprayed coatings are removed by the high-pressure injection from the second injection port. According to the Japanese Unexamined Patent Application Publication No. 2008-303439, the water curtain formed by the low-pressure injection functions to inhibit the high-pressure injection water from being directed toward a sprayed coating formed in the cylinder bore, thereby preventing the sprayed coating from peeling off.

SUMMARY

A crank chamber of a cylinder block of a multi-cylinder engine includes a partition wall that separates each cylinder and supports a journal of a crankshaft. The partition wall includes various holes such as a communication hole and a journal hole. The excess sprayed coating also adheres on the inner surface of these holes. Hence, the excess sprayed coatings adhering on the inner surface of the various holes need to be removed. However, the method for removing the excess sprayed coating according to Japanese Unexamined Patent Application Publication No. 2008-303439 has a following problem: the configuration where the high pressure water is injected in a direction perpendicular to an axial direction of the nozzle (horizontal direction) makes it difficult to sufficiently remove the excess sprayed coating adhering on a surface in an approximately vertical direction with respect to a center axis of the cylinder bore, for example, the inner surface of the communication hole and the journal hole.

The present invention has been made to solve the above-described problem, and it is an object of the present invention to provide a lance nozzle and an excess sprayed coating removal device including the lance nozzle that ensures to more certainly remove an excess sprayed coating, for example, adhering on an inner surface of a hole formed in a crank chamber of a cylinder block.

To achieve the above-mentioned object, the representative present invention is a lance nozzle injecting fluid that includes a shaft body, a first nozzle hole, and a second nozzle hole. The shaft body internally includes a flow path of the fluid. The first nozzle hole is disposed on a leading end side of the shaft body, and generates a first jet in a first injecting direction inclining to a base end side of the shaft body with respect to a direction perpendicular to an axial direction of the shaft body. The second nozzle hole is disposed on a base end side of the first nozzle hole in the shaft body, and generates a second jet in a second injecting direction inclining to a leading end side of the shaft body with respect to a direction perpendicular to an axial direction of the shaft body.

According to the present invention, for example, excess sprayed coatings adhering on an inner surface of a hole disposed in a crank chamber of a cylinder block is removed with more certainty. Note that, descriptions of the following embodiments reveal problems, configurations, and effects other than the above.

BRIEF DESCRIPTION OF THE DRAWINGS

Non-limiting and non-exhaustive embodiments of the present embodiments are described with reference to the following figures, wherein like reference signs refer to like parts throughout the various views unless otherwise specified.

DETAILED DESCRIPTION (First Embodiment)

Figure 1:
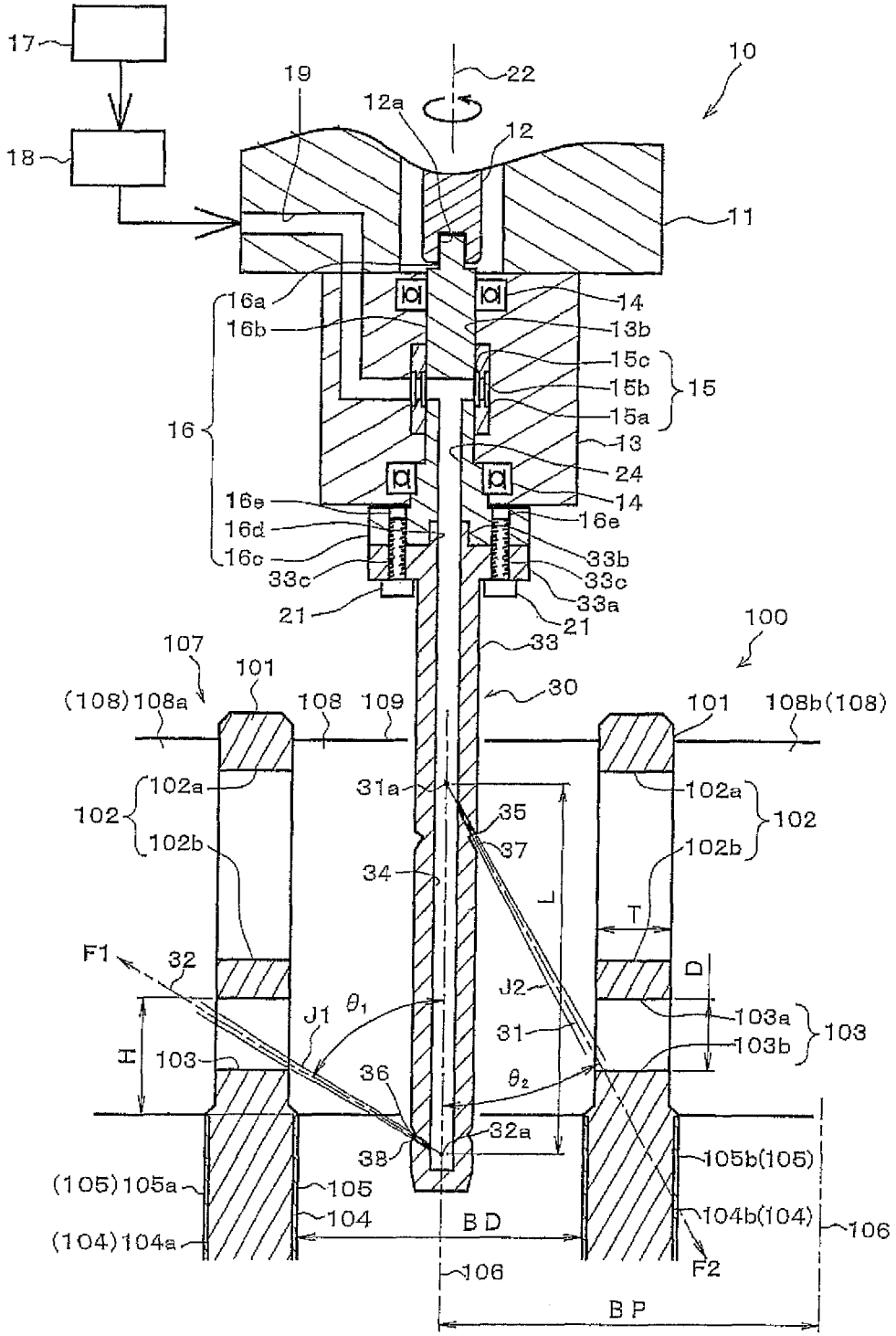
FIG. 1 is a cross-sectional view illustrating an overall configuration of an excess sprayed coating removal device according to a first embodiment.

The embodiments according to the present invention will be described in detail in accordance with the drawings. The first embodiment indicates an exemplary case where an excess coating adhering inside a crank chamber of an in-line multi-cylinder engine is removed. FIG. 1 is a cross-sectional view illustrating an excess sprayed coating removal device 10 including a lance nozzle 30 according to the embodiment, taken along a cross-sectional surface passing through a rotational axis 22 of the lance nozzle 30 in a state where the excess sprayed coating removal device 10 is inserted into an inverted cylinder block 100. Note that, in the following description, "leading end side" means the lower side in FIG. 1, and "base end side" means the upper side in FIG. 1.

The excess sprayed coating removal device 10 inserts the lance nozzle 30 into each of spaces (small chambers) 108 partitioned by partition walls 101 in a crank chamber 107, and removes excess sprayed coatings (not shown) adhering to the crank chamber 107 using jets J1, J2 discharged from nozzle holes 35,36 of the lance nozzle 30.

The excess sprayed coating removal device 10 can be applied as part of a turret cleaning device. Cleaning devices, such as disclosed in Japanese Unexamined Patent Application Publication Nos. 2011-230118 and 2015-58479, can be used as the turret cleaning device.

The excess sprayed coating removal device 10 is equipped with a turret 11 as a spindle casing which is provided to an orthogonal three-axis moving device (not shown). The orthogonal three-axis moving device is controlled, for example, by a numerical control device. The interior of the turret 11 is provided with a rotatably-supported main spindle 12. The main spindle 12 is rotated about the rotational axis 22. A receiving portion 12*a* is provided at the leading end portion of the main spindle 12. The receiving portion 12*a* is formed in the shape of a U-section groove with its length in a direction to penetrate the drawing sheet. The receiving portion 12*a* is engaged with an engaging portion 16*a* of a nozzle supporting member 16 to be described later, and has the function of integrally rotating the nozzle supporting member 16 and the main spindle 12.

The turret 11 is provided with a cylindrical housing 13 about the rotational axis 22. The housing 13 is equipped with a cylindrical hole 13*b*. Bearings 14, packing 15 to be described later, and the nozzle supporting member 16 are inserted in the cylindrical hole 13*b*. The nozzle supporting member 16 is rotatably supported in the housing 13 by the bearings 14.

The nozzle supporting member 16 is composed of the engaging portion 16*a*, a shaft 16*b*, and a flange 16*c* of different diameters coaxially integrally provided, and is generally formed in an approximately cylindrical shape. The engaging portion 16*a* is double-chamfered or a key, both sides thereof being formed flat. Both flat surfaces of the engaging portion 16*a* are caught in the receiving portion 12*a* with a slight clearance therebetween. Thus, the nozzle supporting member 16 rotates in response to the rotation of the main spindle 12. The flange 16*c* is formed in a disk-like shape and has a receiving portion 16*d* and a threaded hole 16*e*. The receiving portion 16*d* is a cylindrical hole which fits a protruding portion 33*b* of the lance nozzle 30.

The cylindrical hole 13*b* is provided with the packing 15. The packing 15 is formed in a hollow cylindrical shape, and a circumferential groove 15*a* with rectangular section is provided in the center of the outer circumference thereof. A circumferential groove 15*c* with rectangular section is also provided in the center of the inner circumference of the packing 15. The packing 15 is provided with at least one through-hole 15*b* that provides communication between the circumferential groove 15*a* and the circumferential groove 15*c*. The packing 15 provides a seal between the housing 13 and the nozzle supporting member 16, and provides communication between flow paths 19 and 24 to be described later. The packing 15 can be made of engineering plastics or super engineering plastics.

A cleaning liquid supplying device 17 supplies cleaning liquid in the range of 10 to 80 MPa, preferably in the range of 30 to 50 MPa. Options of the cleaning liquid supplying device 17 can include a piston pump. The cleaning liquid supplying device 17 discharges the cleaning liquid retained in a cleaning liquid tank not shown. Alkaline or neutral water-soluble cleaning liquid or oily cleaning liquid is available as the cleaning liquid.

A valve 18 switches between the transmission and the interruption of the cleaning liquid from the cleaning liquid supplying device 17 to the turret 11. For example, a solenoid-operated cylinder valve can be used as the valve 18. The opening/closing of the valve 18 is automatically controlled, for example, by a numerical control device. The valve 18 can be configured as a flow path switching valve that returns the cleaning liquid to the cleaning liquid tank during the interruption of the cleaning liquid.

The flow path 19 is provided through the turret 11 and the housing 13. The flow path 19 is provided so as to communicate with the circumferential groove 15*a* of the packing 15. The flow path 24 is formed in T shape, and provided inside the nozzle supporting member 16. One end of the flow path 24 passes through the receiving portion 16*d*. The other end of the flow path 24 opens into the circumferential groove 15*c* of the packing 15. The flow path 19 and the flow path 24 are connected through the circumferential grooves 15*a* and 15*c* and the through-hole 15*b*. The circumferential grooves 15*a* and 15*c* circumferentially distribute the cleaning liquid.

The lance nozzle 30 is equipped with a flange 33*a* and a shaft body 33. The flange 33*a* is formed in a disk-like shape. The flange 33*a* is provided with through-holes 33*c* and the protruding portion 33*b*. The lance nozzle 30 is fixed to the flange 16*c* of the nozzle supporting member 16 by bolts 21 inserted in the through-holes 33*c*. The protruding portion 33*b* provided on the flange 33*a* is fitted and inserted in the receiving portion 16*d* of the nozzle supporting member 16. When the protruding portion 33*b* is fitted into the receiving portion 16*d* and the flange 33*a* and the flange 16*c* are brought into abutting relation, the lance nozzle 30 is accurately fixed to the nozzle supporting member 16.

It should be noted that the lance nozzle 30 can be configured in the shape of a rod without the flange 33*a* in place of the above-described configuration. In this case, the nozzle supporting member 16 is equipped with a collet in place of the flange 16*c*. Furthermore, the rod-shaped lance nozzle 30 may be fixed to the nozzle supporting member 16 by the collet.

The shaft body 33 is a rod-shaped body extending along the rotational axis 22, and preferably is formed in a spindly column shape. A flow path 34 is provided in the center of the shaft body 33. The flow path 34 extends to the vicinity of the leading end of the shaft body 33. The flow path 34 is connected to the flow path 24 of the nozzle supporting member 16.

The shaft body 33 includes a circumferential groove 38 with an approximately V-shaped cross-sectional surface on the leading end portion of the shaft body 33. Here, the "approximately V-shaped" includes a round bottom face and a flat bottom face. The cross-sectional surface of the circumferential groove 38 is not necessary to be disposed in symmetry with respect to the horizontal line. The circumferential groove 38 includes a nozzle hole 36 (a first nozzle hole) to inject high pressure water on a surface on the leading end side of the circumferential groove 38. The nozzle hole 36 communicates with the flow path 34, in which the high pressure water flows, and preferably, the nozzle hole 36 is disposed on slightly base end side with respect to the leading end of the flow path 34. The nozzle hole 36 injects a jet J1 (a first jet) toward an injecting direction F1 (a first injecting direction). The jet J1 is configured such that a centerline 32 of the jet J1 intersects with the rotational axis 22 at an intersection point 32*a*, and an angle between the centerline 32 and the rotational axis 22 is $\theta_1$. Hence, the jet J1 is injected from the nozzle hole 36 toward the base end side inclining by the injection angle of $\theta_1$ from the rotational axis 22, and appears in a cylindrical shape along the centerline 32. Preferably, the surface on the leading end side of the circumferential groove 38 is vertically disposed to the centerline 32 of the jet J1. Disposing the circumferential groove 38 ensures the lance nozzle 30 to be fabricated easier. Further, the peripheral area of the nozzle hole 36 appears on an approximately plane surface. This ensures the jet J1 to be rod-shaped with little turbulence.

On the other hand, the shaft body 33 includes a circumferential groove 37 with an approximately V-shaped cross-sectional surface on the base end side of the nozzle hole 36 of the shaft body 33, more specifically, on the generally center part of the shaft body 33. Here, the "approximately V-shaped" includes a round bottom face and a flat bottom face. The cross-sectional surface of the circumferential groove 37 is not necessary to be disposed in symmetry with respect to the horizontal line. The circumferential groove 37 includes a nozzle hole 35 (a second nozzle hole) to inject high pressure water on a surface on the base end side of the circumferential groove 37. The nozzle hole 35 communicates with the flow path 34, in which the high pressure water flows. The nozzle hole 35 injects a jet J2 (a second jet) toward an injecting direction F2 (a second injecting direction). The jet J2 is configured such that a centerline 31 of the jet J2 intersects with the rotational axis 22 at an intersection point 31*a*, and an angle between the centerline 31 and the rotational axis 22 is $\theta_2$. Hence, the jet J2 is injected from the nozzle hole 35 toward the leading end side inclining by the injection angle of $\theta_2$ from the rotational axis 22, and appears in a cylindrical shape along the centerline 31. Preferably, the surface on the base end side of the circumferential groove 37 is vertically disposed to the centerline 31 of the jet J2. Disposing the circumferential groove 37 ensures the lance nozzle 30 to be fabricated easier. Further, the peripheral area of the nozzle hole 35 appears on an approximately plane. This ensures the jet J2 to be rod-shaped with little turbulence.

Here, the centerline 31 and the centerline 32 are disposed on an identical plane, and faces the opposite direction one another. Additionally, while, in this embodiment, the relation between the angles $\theta_1$ and $\theta_2$ is $\theta_1>\theta_2$, the relation may be $\theta_1=\theta_2$, or $\theta_1<\theta_2$. The angles $\theta_1$ and $\theta_2$ can be appropriately configured corresponding to the shape of the crank chamber 107, the inner diameters of the journal hole 102 and the communication hole 103, and similar factor.

Note that, the cross-sectional shape of the shaft body 33 may be a rectangular and similar shape. In this case, the shaft body 33 is configured such that the center of gravity of the shaft body 33 and the rotational axis 22 are disposed coaxially. Further, the circumferential grooves 37 and 38 may be omitted. Instead of the circumferential grooves 37 and 38, the shaft body 33 may include cut-out portions configured to appear planes perpendicular to the nozzle holes 35 and 36 (planes perpendicular to the centerlines 31 and 32). Note that, each of the centerline 31 and the centerline 32 is not necessary to intersect with the rotational axis 22. However, the centerline 31 and the centerline 32 are preferred to be disposed on a position in a point symmetry with the rotational axis 22 as the center viewing in the direction of the rotational axis 22.

Next, the method for use of the excess sprayed coating removal device 10 configured in this manner and the advantageous effects thereof will be described.

The cylinder block 100 is the cylinder block of the in-line multi-cylinder engine. The cylinder block 100 is installed in an inverted manner with the cylinder head installation surface (not shown) facing downward in the vertical direction. The cylinder block 100 is equipped with the plurality of cylinder bores 104. The crank chamber 107 is partitioned into the spaces (small chambers) 108 by the partition walls 101 for each of the cylinder bores 104. The partition walls 101 are each provided with a journal hole 102 and the communication hole 103. The communication hole 103 is a so-called vent. The cylinder bores 104 of the cylinder block 100 are film-formed with the sprayed coating 105. At this time, excess sprayed coatings adhere to almost the entire inner surface of the crank chamber 107.

At the time of using the excess sprayed coating removal device 10, the cleaning liquid supplying device 17 is firstly operated. Then the main spindle 12 is rotated. The nozzle supporting member 16 and the lance nozzle 30 are rotated with the rotation of the main spindle 12. The rotational axis 22 of the lance nozzle 30 is positioned spacedly above the crank chamber 107 in an extension of the bore center 106 of the cylinder bore 104. The numerical control device switches the valve 18 to supply cleaning liquid to the turret 11. The cleaning liquid is supplied to the nozzle holes 35, 36 through the valve 18, the flow path 19, the flow path 24, and the flow path 34 from the cleaning liquid supplying device 17. The cleaning liquid is discharged as the jet J1 from the nozzle hole 36, and discharged as the jet J2 from the nozzle hole 35. The nozzle hole 35 and the nozzle hole 36 are disposed in the point symmetry with the rotational axis 22 as the center viewing in the direction of the rotational axis 22. Then, the injection of the jet J1 and the jet J2 cancels the reactive force that the shaft body 33 receives. Moving the turret 11 downward along the bore center 106 causes the jet J2 to collide with the inner surfaces of a skirt 109 and the partition wall 101 that partition the space 108. This peels off the excess sprayed coatings that adhere on the inner surfaces.

Continuously moving the turret 11 downward also causes the jet J1 to start colliding with the inner surfaces of the skirt 109 and the partition wall 101. The jet J2 inclines to the leading end direction of the lance nozzle 30. Then, the jet J2 removes the excess sprayed coatings adhering on an inner surface 102*b* of the lower side of the journal hole 102 and an inner surface 103*b* of the lower side (hereinafter referred to as "a lower-side inner surface 103*b*") of the communication hole 103. On the other hand, the jet J1 inclines to the base end direction of the lance nozzle 30. Then, the jet J1 removes the excess sprayed coatings adhering on an inner surface 102*a* of the upper side of the journal hole 102 and an inner surface 103*a* of the upper side (hereinafter referred to as "an upper-side inner surface 103*a*") of the communication hole 103. The lance nozzle 30 is mostly configured such that, on the position when the jet J2 passes through the lower-side inner surface 103*b* of the communication hole 103, the jet J1 passes through the upper-side inner surface 103*a* of the communication hole 103.

After the excess sprayed coating removal device 10 moved the lance nozzle 30 downward to the extent that the jets J1 and J2 do not collide with the cylinder bore 104, the excess sprayed coating removal device 10 moves the lance nozzle 30 upward. When the lance nozzle 30 is raised to the position before the insertion at the first, the excess sprayed coating removal device 10 determines the position of the lance nozzle 30 to the bore center of a next cylinder bore 104*b*. Then, the excess sprayed coating removal device 10 removes the excess sprayed coating adhering in a space 108*b* of the crank chamber 107 as well as the above-described procedure. The excess sprayed coating removal device 10 removes the excess sprayed coating of every space 108 separated by the partition wall 101 of the crank chamber 107.

As described above, the lance nozzle 30 according to the embodiment includes the nozzle hole 36 (the first nozzle hole) that inclines in the base end direction of the lance nozzle 30 on the leading end portion of the lance nozzle 30, and includes the nozzle hole 35 (the second nozzle hole) that inclines in the leading end direction of the lance nozzle 30 on the intermediate position of the nozzle hole 36 and the base end portion. Hence, when the lance nozzle 30 is inserted from the crank chamber 107 side along the bore center 106, the jet J1 (the first jet) generated from the nozzle hole 36 and the jet J2 (the second jet) generated from the nozzle hole 35 can be disposed to reach an approximately identical height near the partition wall 101.

Then, the jet J1 and the jet J2 are inclined in the base end direction (F1 direction) and the leading end direction (F2 direction) respectively. This ensures the jets J1 and J2 to directly reach the inner surfaces of the journal hole 102 and the communication hole 103 that are disposed on the partition wall 101. In view of this, the lance nozzle 30 according to the embodiment can effectively remove the excess sprayed coating, which is difficult to be removed by conventional technology, adhering on surfaces facing in the direction approximately perpendicular to the bore center 106 (such as the inner surface of the journal hole 102 and the communication hole 103). The crank chamber 107 includes a wall surface where a part adjacent to the cylinder bore 104 is disposed approximately perpendicular to the bore center 106. The angle $\theta_2$ is a small angle, then, the part adjacent to the cylinder bore 104 in the crank chamber 107 receives the strong jet J2. This effectively removes the excess sprayed coating adhering on the part.

Further, according to the lance nozzle 30 of the embodiment, the jet J1 and the jet J2 reach the approximately identical height near the wall surfaces of the partition wall 101 and the cylinder bore 104. This ensures the lance nozzle 30 to be deeply inserted. When the lance nozzle 30 is inserted until any one of the jet J1 and the jet J2 reaches the position slightly biased to the crank chamber 107 with respect to the upper end of the cylinder bore 104, the excess sprayed coating adhering on the crank chamber 107 is removed without almost any blind spots.

The necessary sprayed coating 105 formed on the cylinder bore 104 is damaged by the jets J1 and J2 colliding with the sprayed coating 105. The nozzle hole 35 of the lance nozzle 30 according to the embodiment is preferred to be disposed with a steep inclination to the extent that the jet J2 does not pass through the communication hole 103. This configuration prevents the jet J2 from passing through the communication hole 103 and entering into next spaces 108*a* and 108*b* from the space 108 where the lance nozzle 30 is inserted. Hence, the jet J2 is prevented from colliding with the inner surfaces of cylinder bores 104*a* and 104*b* coupled to the spaces 108*a* and 108*b* respectively. This prevents sprayed coatings 105*a* and 105*b* formed on the cylinder bores 104*a* and 104*b* from being damaged.

Figure 2:
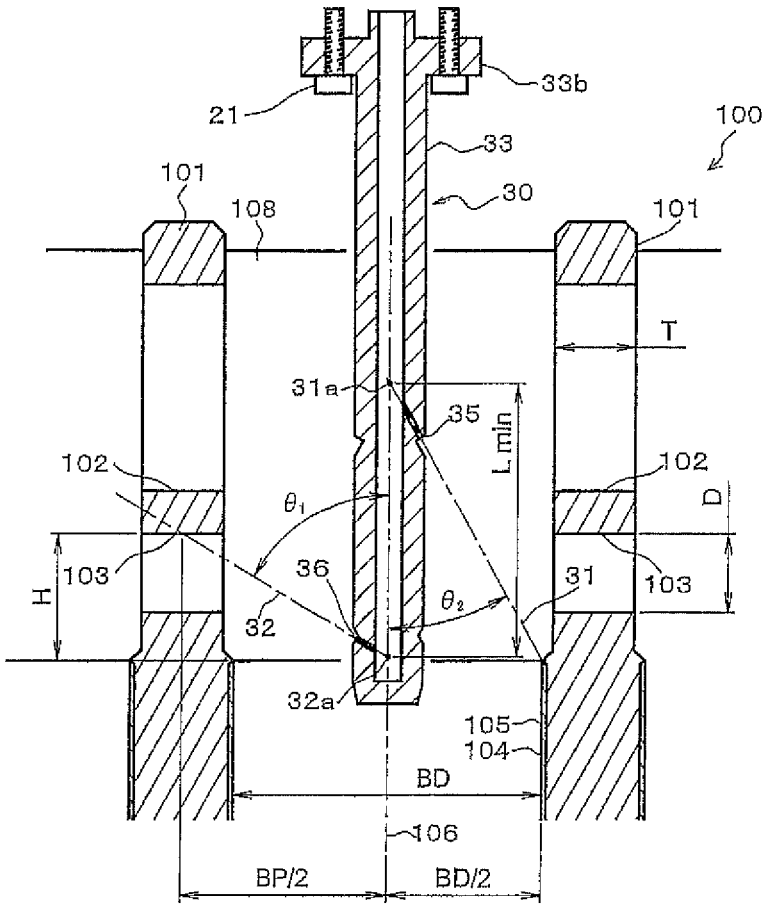
FIG. 2 is a schematic diagram illustrating a design limit of a lance nozzle indicated in FIG. 1.
Figure 3:
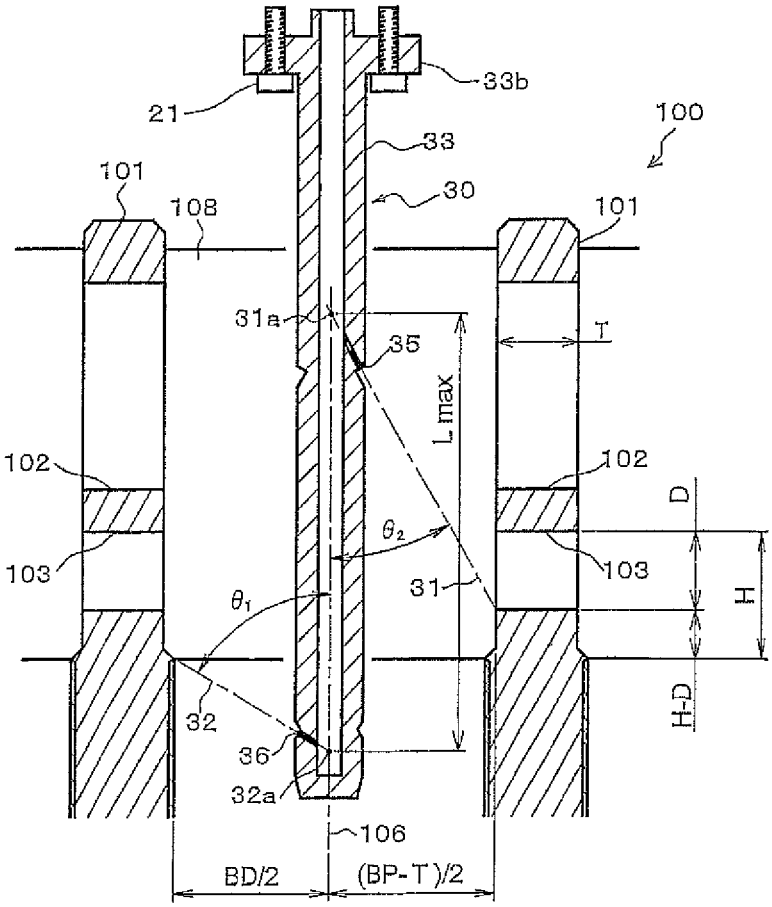
FIG. 3 is a schematic diagram illustrating the design limit of the lance nozzle indicated in FIG. 1.

Next, a description will be given of a design limit of the preferred lance nozzle 30 referring to FIG. 2 and FIG. 3 in addition to FIG. 1. FIG. 2 and FIG. 3 are schematic diagrams illustrating the design limit of the lance nozzle illustrated in FIG. 1.

Referring to FIG. 1, the jet J2 is preferred to be configured not to pass through the communication hole 103. Preferably, an inclination angle of the nozzle hole 35, that is, an angle (injection angle) $\theta_2$ formed by the centerline 31 of the jet J2 and the rotational axis 22 of the shaft body 33 is configured in a range of the following formula.

$$0 < \theta_2 \leq \tan^{-1}\left(\frac{T}{D}\right) \quad \text{[Formula 4]}$$

Where

D: representative length (length of a hole along the bore center 106) of a hole (such as the journal hole 102 or the communication hole 103); and T: representative thickness of the partition wall 101.

If the jet J2 is configured in a range of the above formula, the jet J2 does not pass through the hole disposed on the partition wall 101 (such as the journal hole 102 or the communication hole 103). Hence, the jet J2 does not damage the sprayed coatings 105*a* and 105*b* of the cylinder bores 104*a* and 104*b*. Note that, the jet J2 that passes through the journal hole 102 does not damage the sprayed coating 105*b* depending on the pressure and the flow rate of the jet J2 because the distance between the nozzle hole 35 and the sprayed coating 105*b* is far. In this case, the jet J2 may pass through the journal hole 102.

The jet J1 is less likely to damage the necessary sprayed coating because the jet J1 inclines upward (toward the base end). The jet J1 is preferred to be configured to reach at least a half of the depth of the partition wall 101 viewing from the space 108, into which the lance nozzle 30 is inserted. Preferably, an inclination angle of the nozzle hole 36, that is, an angle (injection angle) $\theta_1$ formed by the centerline 32 of the jet J1 and the rotational axis 22 of the shaft body 33 is configured in a range of the following formula.

$$\tan^{-1}\left(\frac{T}{2D}\right) \leq \theta_1 < 90° \quad \text{[Formula 5]}$$

Where

D: representative length (length of a hole along the bore center 106) of a hole (such as the journal hole 102 or the communication hole 103); and T: representative thickness of the partition wall 101.

Note that, if it is not necessary to consider that the jet J2 passes through the journal hole 102, as D and T, the length relating to the communication hole 103 is available. The same applies to the following description.

Referring to FIG. 2, a minimum distance $L_{min}$ between the intersection point 31*a* and the intersection point 32*a* will be described. A fall limit of the turret 11 is a position where the centerline 31 of the jet J2 reaches the upper end of the cylinder bore 104. On the position, the jet J1 is preferred to be configured to remove the excess sprayed coating of the front half of the depth of the upper-side inner surface 103*a* of the communication hole 103. The preferable $L_{min}$ is provided by the following formula.

$$L_{min} = \frac{BP}{2\tan\theta_1} + \frac{BD}{2\tan\theta_2} - H \quad \text{[Formula 6]}$$

Where

BP: distance of the pitch between the cylinder bores 104;

BD: diameter of the cylinder bore 104;

$\theta_1$: angle formed by the centerline 32 of the jet J1 and the rotational axis 22 of the shaft body 33;

$\theta_2$: angle formed by the centerline 31 of the jet J2 and the rotational axis 22 of the shaft body 33; and H: height from the upper end of the cylinder bore 104 to the upper-side surface of the communication hole 103 disposed on the partition wall 101 in the case where the cylinder block 100 is inverted.

Referring to FIG. 3, a maximum distance $L_{max}$ between the intersection point 31*a* and the intersection point 32*a* will be described. The fall limit of the turret 11 is a position where the centerline 32 of the jet J1 reaches the upper end of the cylinder bore 104. On the position, the jet J2 is preferred to be configured to remove the excess sprayed coating of the entire lower-side inner surface 103*b* of the communication hole 103. The preferable $L_{max}$ is provided by the following formula.

$$L_{max} = \frac{BD}{2\tan\theta_1} + \frac{BP - T}{2\tan\theta_2} + H - D \quad \text{[Formula 7]}$$

Where

BD: diameter of the cylinder bore 104;

BP: distance of the pitch between the cylinder bores 104;

T: representative thickness of the partition wall 101;

$\theta_1$: angle formed by the centerline 32 of the jet J1 and the rotational axis 22 of the shaft body 33;

$\theta_2$: angle formed by the centerline 31 of the jet J2 and the rotational axis 22 of the shaft body 33;

H: height from the upper end of the cylinder bore 104 to the upper-side surface of the communication hole 103 disposed on the partition wall 101 in the case where the cylinder block 100 is inverted; and D: representative length (length of a hole along the bore center 106) of a hole (such as the journal hole 102 or the communication hole 103).

Accordingly, a distance L (distance between the intersection point 31*a* and the intersection point 32*a*) between the nozzle hole 35 and the nozzle hole 36 in an axial direction of the shaft body 33 is preferred to be configured in a range of the following formula.

$$\frac{BP}{2\tan\theta_1} + \frac{BD}{2\tan\theta_2} - H \le L \le \frac{BD}{2\tan\theta_1} + \frac{BP - T}{2\tan\theta_2} + H - D \quad \text{[Formula 8]}$$

Where

BP: distance of the pitch between the cylinder bores 104;

BD: diameter of the cylinder bore 104;

$\theta_1$: angle formed by the centerline 32 of the jet J1 and the rotational axis 22 of the shaft body 33;

$\theta_2$: angle formed by the centerline 31 of the jet J2 and the rotational axis 22 of the shaft body 33;

T: representative thickness of the partition wall 101;

H: height from the upper end of the cylinder bore 104 to the upper-side inner surface of the communication hole 103 disposed on the partition wall 101 in the case where the cylinder block 100 is inverted; and D: representative length (length of a hole along the bore center 106) of a hole (such as the journal hole 102 or the communication hole 103).

Note that, the excess sprayed coating removal device 10 according to the embodiment is applicable to a cylinder block of a single cylinder engine, a V-type multi-cylinder engine with a bank angle of 180°, or a horizontally-opposed type multi-cylinder engine other than the cylinder block 100 of the in-line multi-cylinder engine.

Furthermore, the excess sprayed coating removal device 10 according to the embodiment includes the turret 11. Hence, the excess sprayed coating removal device 10 can mount a direct jet nozzle that downwardly injects the cleaning solution in the axis direction, an L-shaped nozzle that includes a nozzle hole to inject the cleaning solution from the shaft portion extending in the axis direction and the leading end portion of the shaft portion vertically to the axis, and similar nozzle on the turret 11 by each turret surface other than the lance nozzle 30. The excess sprayed coating removal device 10 of the turret type can properly use these nozzles to remove the excess sprayed coating adhering on the cylinder block 100.

While, in the above description, the cylinder block 100 is described with an inverted state, it is needless to say that the cylinder block can be disposed in other directions. Further, while the excess sprayed coating removal device 10 is described with the turret type cleaning device, a cleaning device without a turret is also applicable.

(Second Embodiment)

Figure 4:
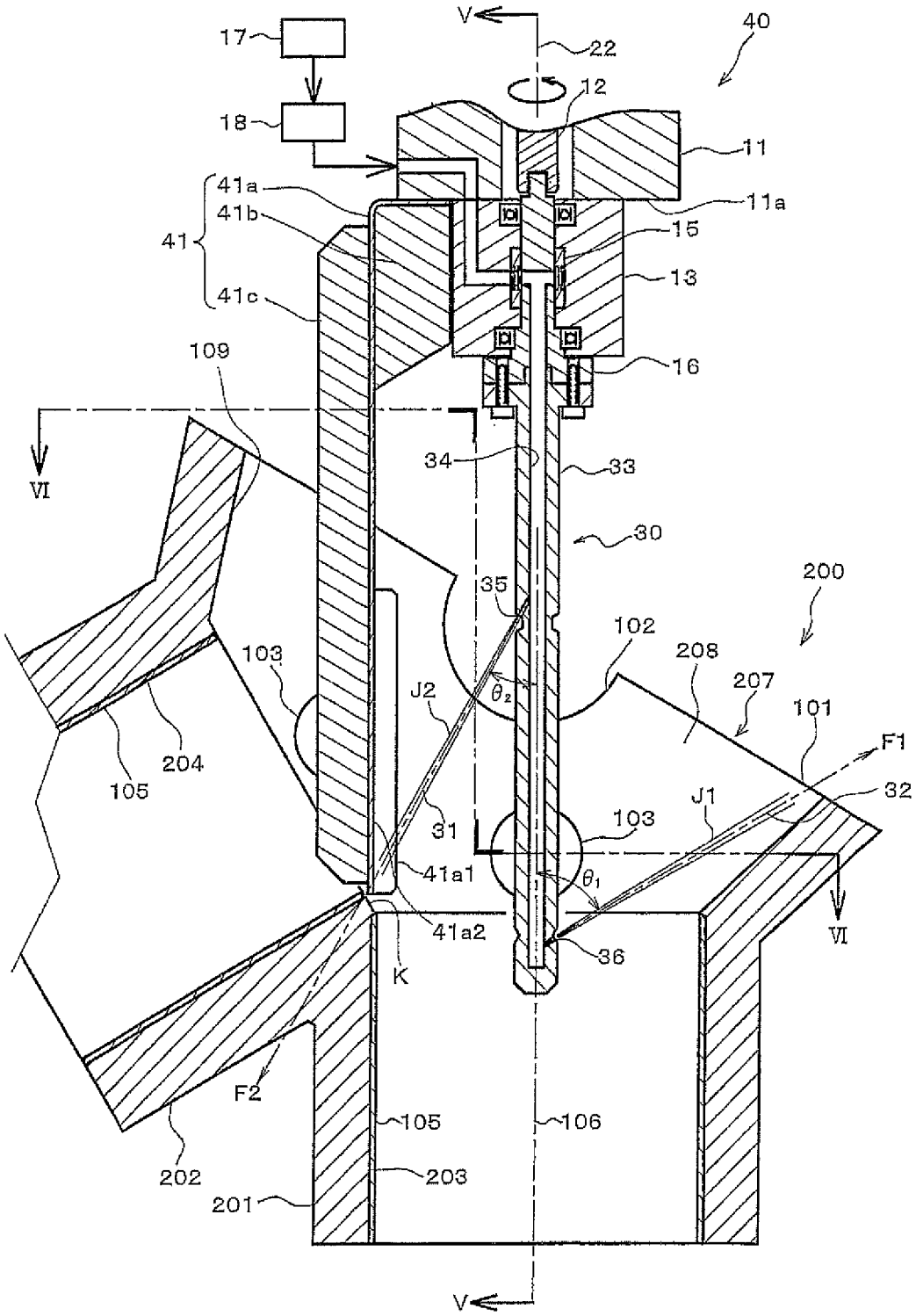
FIG. 4 is a cross-sectional view illustrating an overall configuration of an excess sprayed coating removal device according to a second embodiment.
Figure 5:
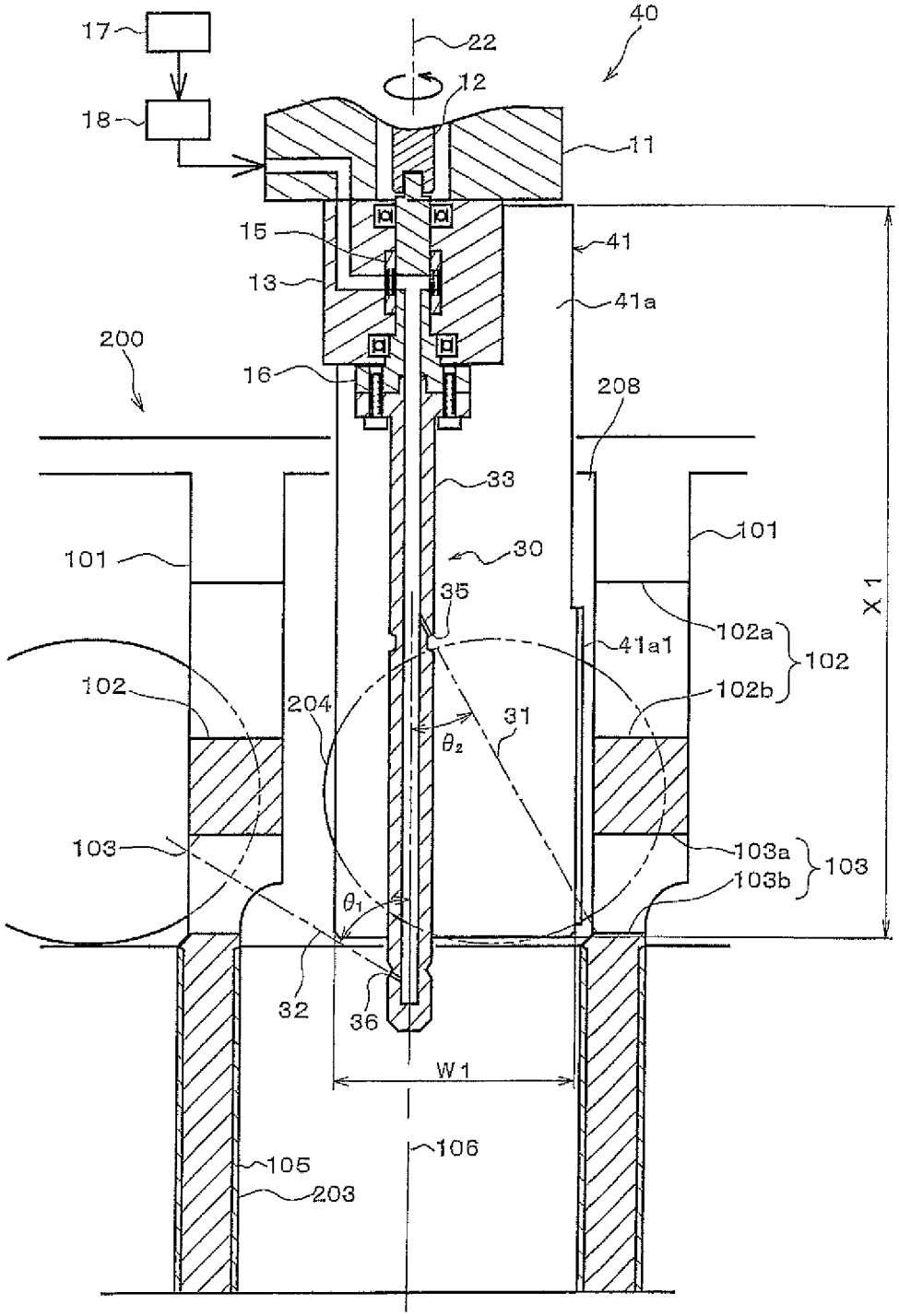
FIG. 5 is a cross-sectional view taken along a line V-V in FIG. 4.
Figure 6:
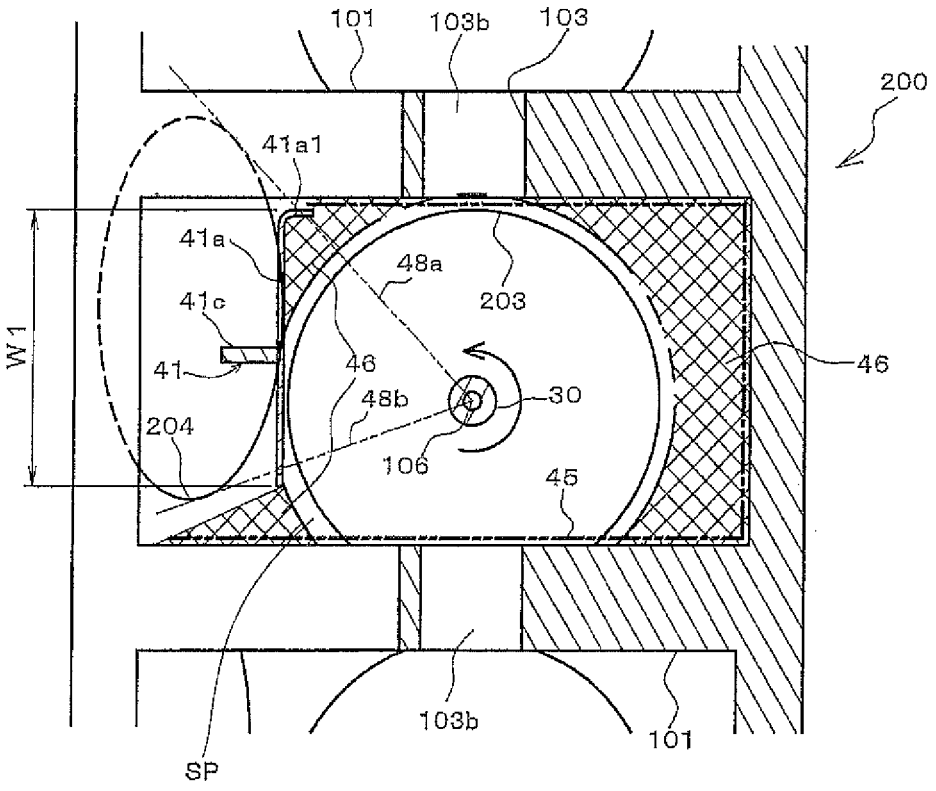
FIG. 6 is a cross-sectional view taken along a line VI-VI in FIG. 4.
Figure 7:
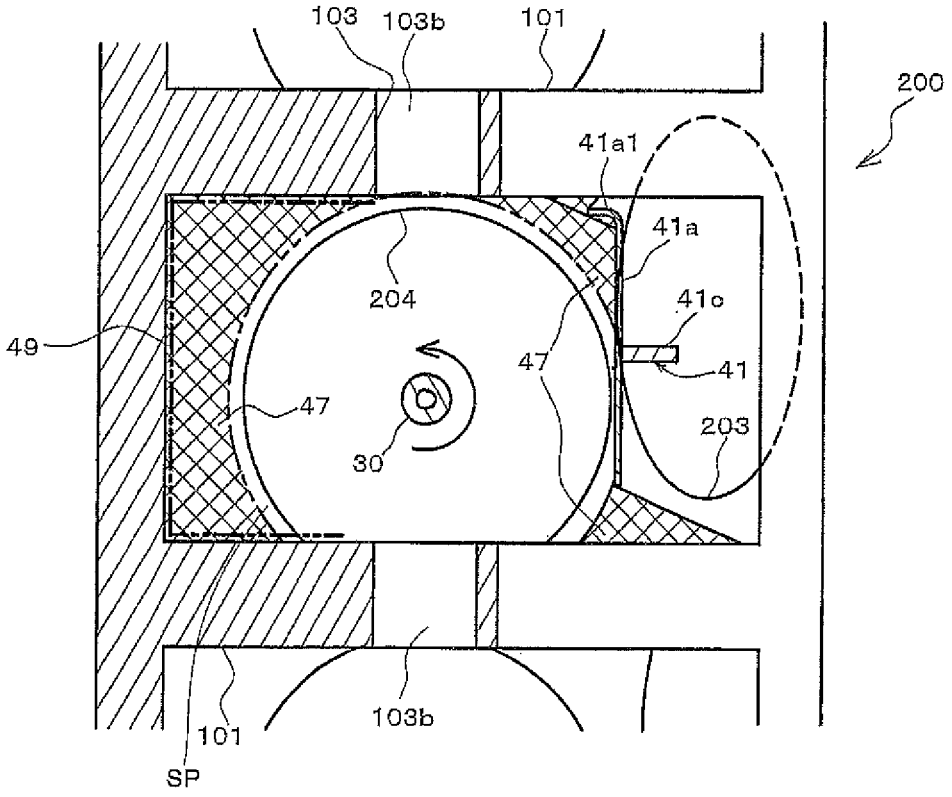
FIG. 7 is a schematic diagram illustrating a method for using the excess sprayed coating removal device according to the second embodiment.

A second embodiment will be described referring to FIG. 4 to FIG. 7. FIG. 4 is a vertical cross-sectional view of a lance nozzle 30 of an excess sprayed coating removal device 40 according to the second embodiment taken along a cross-sectional surface passing through a rotational axis 22, in a state where the lance nozzle 30 is inserted into an inverted cylinder block 200. Further, FIG. 5 is a cross-sectional view taken along a line V-V in FIG. 4, FIG. 6 is a cross-sectional view taken along a line VI-VI in FIG. 4, and FIG. 7 is a schematic diagram illustrating a method for using the excess sprayed coating removal device 40 according to the second embodiment.

The excess sprayed coating removal device 40 according to the second embodiment is applied to the cylinder block 200 of a V-type multi-cylinder engine. A crank chamber 207 of the cylinder block 200 is partitioned by the partition walls 101 into spaces (small chambers) 208 which each accommodate cylinder bores 203 and 204 two by two provided in two banks 201 and 202, respectively, offset in phase. The cylinder bores 203 and 204 are provided so as to be offset longitudinally with respect to each other.

The excess sprayed coating removal device 40 includes a shield 41. The shield 41 is removably secured to a turret 11, and integrally moves with the turret 11. Then, when the lance nozzle 30 moves in an axial direction, the shield 41 moves in accordance with the move of the lance nozzle 30. The excess sprayed coating removal device 40 further includes a tilting device (unillustrated) that tilts the cylinder block 200. The other configurations are similar to the first embodiment. Like reference numerals designate corresponding or identical elements to those of the first embodiment, and therefore such elements will not be further elaborated here.

The tilting device tilts the cylinder block 200 so that the cylinder bore 203 of one 201 of the banks faces downward in the vertical direction or the cylinder bore 204 of the other bank 202 faces downward in the vertical direction. A well-known tilting device (for example, a rotary table) can be used as the tilting device.

Referring to FIG. 4 and FIG. 5, nozzle holes 35 and 36 are disposed with a positional relationship where, when the lance nozzle 30 is inserted into the crank chamber 207 along a bore center 106, the excess sprayed coating adhering on an inner surface of a communication hole 103 can be removed, and disposed such that jets J1 and J2 are cutoff by the shield 41 not to enter into the cylinder bore 204 of the bank 202.

The shield 41 is composed of: a shield plate 41*a* that receives the jets J1 and J2 from the nozzle holes 35 and 36 of the lance nozzle 30; and reinforcing plates 41*b* and 41*c* that reinforce the shield plate 41*a*. The shield plate 41*a* is a plate bent into an inverted L shape when seen in the longitudinal direction (direction perpendicular to the drawing sheet of FIG. 4) of the cylinder block 200. The shield plate 41*a* has a shape (see FIG. 5) with a short side W1 one-third or more the diameter of the cylinder bore 204 (the other cylinder bore) but less than the diameter of the cylinder bore 204 and a long side X1 exceeding the length of the lance nozzle 30, and is disposed at a position offset in the horizontal direction in FIG. 4 from the lance nozzle 30 by a distance almost equal to the radius of the cylinder bore 203.

The length of the short side W1 is configured such that, when the lance nozzle 30 is inserted along the bore center 106, the end portion of the shield plate 41*a* on the side where the cylinder bore 204 is not disposed in the front-back direction of the engine (downward direction in FIG. 6) reaches at least a tangent 48*b* of the bore center 106 and the cylinder bore 204 (see FIG. 6).

With this configuration, when the lance nozzle 30 is inserted into the bore center 106, the shield plate 41*a* is located directly above the boundary K between the banks 201 and 202 (boundary between the one cylinder bore 203 and the other cylinder bore 204). Furthermore, the long side X1 of the shield plate 41*a* is set so that the shield plate 41*a* is prevented from making contact with the cylinder block 200 by leaving a slight gap therebetween when the lance nozzle 30 is inserted to the bottom end (state in FIG. 4). Further, the leading end portion of the shield plate 41*a* is formed with a block portion 41*a*2 that shuts the jets J1 and J2. It should be noted that the center of the shield plate 41*a* may be hollowed out in any portion except the block portion 41*a*2.

The block portion 41*a*2 is formed integrally with the shield plate 41*a*, and has a simple configuration. The block portion 41*a*2 erodes due to jets impinging thereon. The block portion 41*a*2 may be formed in a tabular shape or may have a central portion raised toward the direction of the lance nozzle 30 in plan view. Furthermore, the surface of the block portion 41*a*2 may be configured so as to be inclined in such a manner that the distance from the lance nozzle 30 decreases towards the leading end side. The block portion 41*a*2 may be fixed to the shield plate 41*a*, for example by a bolt. In this case, the shield plate 41*a* serves as a supporting member of the block portion 41*a*2. In this case, it is unnecessary to provide the reinforcing plates 41*b* and 41*c*. The block portion 41*a*2 also may be configured so as to have a thickness more than the shield plate 41*a*. The block portion 41*a*2 may be configured from a laminated material composed of a plurality of layers.

The reinforcing plate 41*b* supports, from inside, a bent portion located at an upper portion of the shield plate 41*a*. The reinforcing plate 41*c* is provided outside the shield plate 41*a* so as to be elongated in a direction parallel to the lance nozzle 30. The reinforcing plates 41*b* and 41*c* are provided at the width center of the shield plate 41*a* (see FIG. 6), and prevent the shield plate 41*a* from being deformed under the dynamic pressure of the jets J1 and J2.

Referring to FIGS. 4 and 6, a bent side portion 41*a*1 bent in the direction of the lance nozzle 30 is provided at one end in the longitudinal direction of the shield plate 41*a* on the side on which the cylinder bore 204 of the bank 202 is provided. When the lance nozzle 30 is positioned with respect to the bore center 106 of the cylinder bore 203, the bent side portion 41*a*1 has, in plan view, at least a height such that it reaches a tangent 48*a* to the cylinder bore 204 passing through the bore center 106 of the cylinder bore 203. At this time, preferably, the bent side portion 41*a*1 is provided as close to the partition wall 101 as possible. The bent side portion 41*a*1 prevents the jets J1 and J2 (especially jet j2) from impinging on the sprayed coating 105 provided on the inner surface of the cylinder bore 204. The leading end portion of the bent side portion 41*a*1 constitutes part of the block portion 41*a*2. It should be noted that the bent side portion 41*a*1 are unnecessary depending on the conditions, such as the required pressure of the jets J1 and J2.

Next, the method for use of the excess sprayed coating removal device 40 configured in this manner and the advantageous effects thereof will be described. The tilting device tilts the cylinder block 200 so that the cylinder bore 203 faces downward. Then the lance nozzle 30 rotating while jetting cleaning nozzle is inserted into the space 208 to remove the excess sprayed coatings adhering to the inner surface of the space 208 while moving the lance nozzle 30 downward along the bore centers 106 of all cylinder bores 203 associated with the bank 201.

The jet J2 inclines toward an oblique leading end direction. Then, the jet J2 collides with the partition wall 101 and a skirt 109 on the part indicated by a bold two-dot chain line 45 in FIG. 6. Then, during lowering the lance nozzle 30 with rotating, the excess sprayed coating adhering on the top surface of the crank chamber 107 is also removed gradually from the peripheral portion. In this case, the shield 41 positions so as to face an opening of the cylinder bore 204 that communicates with the space 208, and the block portion 41*a*2, which is disposed on the leading end portion of the shield plate 41*a*, intercepts the jets J1 and J2. This prevents the jets J1 and J2 from colliding with the inner surface of the cylinder bore 204.

When the lance nozzle 30 is lowered to the lowermost, an annular space SP where the excess sprayed coating cannot be removed is left around the cylinder bore 203. The lance nozzle 30 returns to rise and removes the excess sprayed coating again with the jets J1 and J2. In this process, the area where the excess sprayed coating can be removed is an area of a cross hatching 46. At this time, the excess sprayed coatings adhering on the upper-side inner surface 103*a* and the lower-side inner surface 103*b* of the communication hole 103, and on inner surfaces 102*a* and 102*b* of a journal hole 102 are also removed. Then, the excess sprayed coating of one half side of the space 208 of the crank chamber 207 can be removed.

Here, the shield plate 41*a* lowers with the lance nozzle 30 to the extent that the shield plate 41*a* does not contact with the cylinder block 200. Accordingly, the shield plate 41*a* receives the jets J1 and J2 near the leading end portion to expand the wall surface of the crank chamber 207 with which the jets J1 and J2 can contact. That is, the nearer to the leading end the position where the shield plate 41*a* receives the jets J1 and J2 is disposed, the more the removal range of the excess sprayed coating can be expanded.

Subsequently, the excess sprayed coating of the other half of the space 208 of the crank chamber 207 is removed. The tilting device tilts the cylinder block 200 such that the cylinder bore 204 faces downward. In this case, the mounting position of the shield 41 to the turret 11 is moved by 180° in the rotation direction of the lance nozzle 30. Alternatively, another turret surface of the turret 11 (unillustrated) that is configured such that the shield 41 is rotated by 180° in FIG. 6 is preliminarily prepared. Then, the following configuration may be employed: when the excess sprayed coating is removed in a state where the cylinder bore 203 faces downward, a turret surface 11*a* with the configuration in FIG. 6 (see FIG. 4) is determined to use, and when the excess sprayed coating is removed in a state where the cylinder bore 204 faces downward, the other turret surface where the shield 41 is mounted on the opposite position to the configuration in FIG. 6 is determined to use. Note that, the other turret surface is such as a surface on the opposite side to the turret surface 11*a* of the turret 11.

FIG. 7 illustrates a state where the cylinder block 200 is tilted from a state in FIG. 6 such that the cylinder bore 204 faces downward. In the removal step of the excess sprayed coating in FIG. 6, the shield 41 is inserted so as to face the opening of the cylinder bore 204. Then, the excess sprayed coating in the region of a cross hatching 47 illustrated in FIG. 7 is not removed. To remove the excess sprayed coating in the region of the cross hatching 47, it is necessary to incline the cylinder block 200 such that the cylinder bore 204 faces downward.

Lowering the lance nozzle 30 with rotating in a state of FIG. 7 processes the region of the cross hatching 47 and the part of a bold two-dot chain line 49 in the wall surface of the space 208. Therefore, the excess sprayed coating removal device 40 can remove the excess sprayed coating of most regions except the peripheral area of the cylinder bores 203 and 204 in the crank chamber 207 of the cylinder block 200. In this case, the shield 41 of which the mounting position is rotated by 180° from the mounting position in FIG. 6 intercepts the jets J1 and J2 to prevent the sprayed coating 105 on the inner surface of the cylinder bore 203 from peeling. This ensures the excess sprayed coating removal device 40 to surely remove the excess sprayed coating inside the crank chamber 207 without peeling the sprayed coating 105 formed on the cylinder bore even with respect to the V-type multi-cylinder engine.

It should be noted that in the above description, the case where the mounting position of the shield 41 is changed between the banks 201 and 202, or the case where the turret surface 11*a* for the bank 201 and a turret surface for the bank 202 (not shown) are preliminarily prepared to determine the turret 11. However, alternatively, a turning device for turning the cylinder block 200 through 180° in plan view may be provided. In this case, the position of the cylinder bore 204 with respect to the cylinder bore 203 before turning, and the position of the cylinder bore 203 with respect to the cylinder bore 204 when the cylinder block 200 is turned 180° and tilted are the same. Thus, the combination of the nozzle 30 and the shield 41 is applicable to the bank 201 and the bank 202 in common. Furthermore, two excess sprayed coating removal devices 40 may be provided so that one of the excess sprayed coating removal devices 40 processes one bank (for example, the right bank) and the other excess sprayed coating removal device 40 processes the other bank (for example, the left bank). In addition, the arrangement may be such that the single turret 11 is mounted with a pair of shields 41 arranged with a pitch of 180°.

(Third Embodiment)

Figure 8:
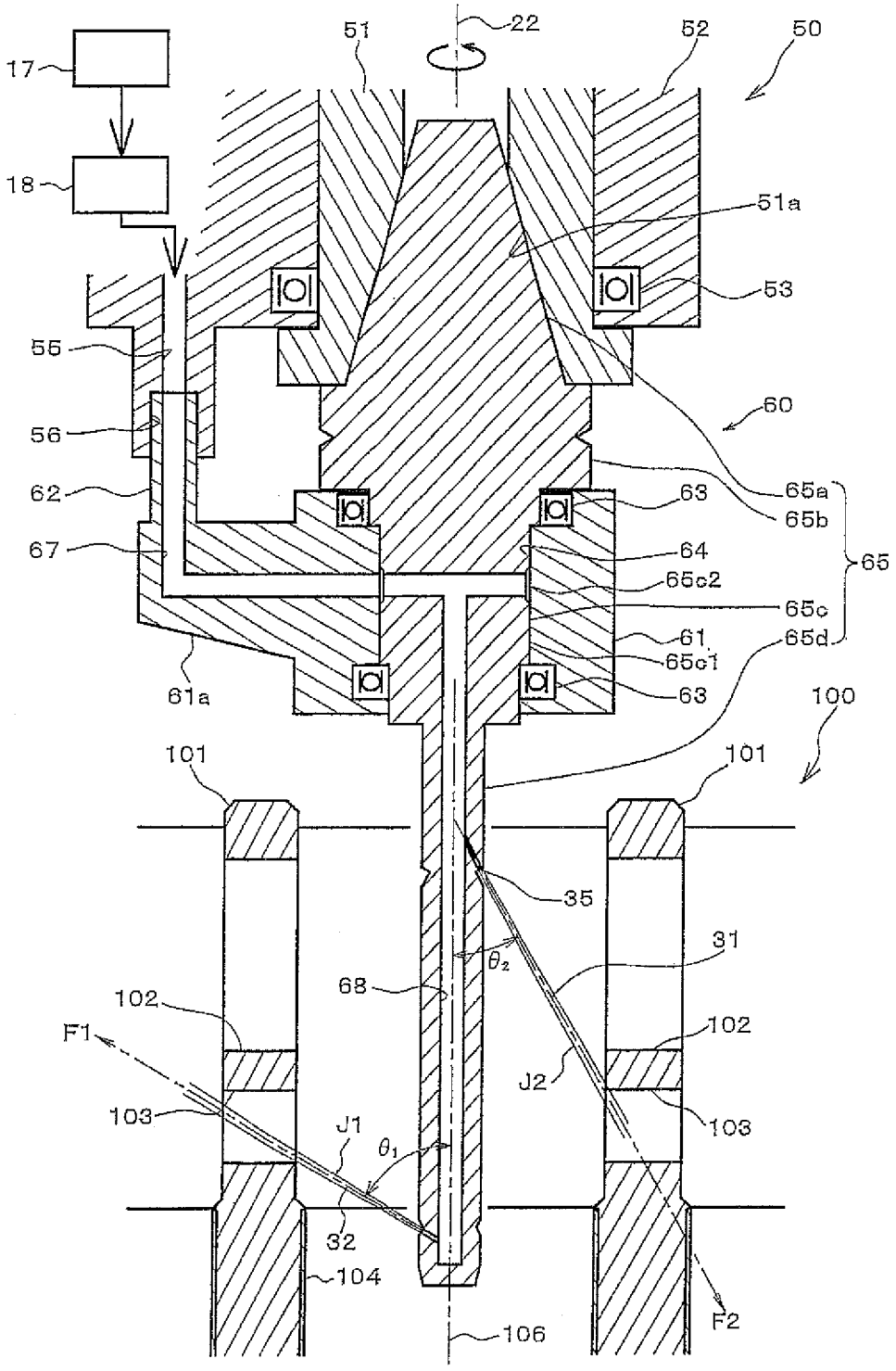
FIG. 8 is a cross-sectional view illustrating an overall configuration of an excess sprayed coating removal device according to a third embodiment.

A third embodiment will be described with reference to FIG. 8. FIG. 8 is a longitudinal sectional view of an excess sprayed coating removal device 50 according to the third embodiment taken along the rotational axis 22 of a lance nozzle 60, with the lance nozzle 60 inserted in the inverted cylinder block 100.

The lance nozzle 60 of the third embodiment differs from the excess sprayed coating removal device 10 of the first embodiment in that an automatic-tool-changing cleaning machine is used. The automatic-tool-changing cleaning machine has a general structure similar to a machining center. However, while the machining center is used for cutting, the automatic-tool-changing cleaning machine is used for cleaning or deburring using jets. Furthermore, the high-pressure cleaning liquid in the range of 10 to 80 MPa is supplied to the main spindle. Therefore, although the machining center and the automatic-tool-changing cleaning machine differ from each other mainly in accuracy, mechanical stiffness, and mildew resistance, the major structures thereof are the same. Under such circumstances, differences from the first embodiment will be described in detail in the following description, in which like reference signs denote like portions and the description thereof is omitted.

In the excess sprayed coating removal device 50, a main spindle 51 with a shank hole 51*a* is rotatably supported by a bearing 53 in a main spindle head 52 as a spindle casing which is provided to an orthogonal three-axis moving device. The main spindle head 52 is provided with a detent hole 56 adjacent to the shank hole 51*a*. The main spindle head 52 is provided with a flow path 55 opening into the detent hole 56. The detent hole 56 is provided with packing (not shown) for sealing the detent hole 56 with respect to an insertion portion 62.

The lance nozzle 60 is replaced by means of an automatic tool changing device not shown. The lance nozzle 60 is equipped with: a body 61; a rotor 65 that journaled to the body 61; and flow paths 67 and 68 that supplies cleaning liquid to the interior of the rotor 65 from the detent hole 56.

The body 61 has a general cylindrical shape, and the abdomen of the body 61 is equipped with a protruding portion 61*a*. The protruding portion 61*a* is equipped with the insertion portion 62 that is inserted into the detent hole 56. When the lance nozzle 60 is installed in the main spindle 51, the insertion portion 62 is fitted and inserted into the detent hole 56. A cylindrical hole 64, which is a stepped through-hole, is provided in the center of the body 61. Bearings 63 are provided at either end of the cylindrical hole 64.

The rotor 65 includes a taper shank 65*a*, a flange 65*b*, a cylindrical portion 65*c*, and a shaft body 65*d* integrally manufactured. The taper shank 65*a* is equipped with a conic surface in close contact with the shank hole 51*a*. When the taper shank 65*a* and the shank hole 51*a* are brought into close contact with each other, the lance nozzle 60 is installed in the main spindle 51. At this time, since the insertion portion 62 is inserted into the detent hole 56, the body 61 does not rotate. The flange 65*b* is formed in a disk-like shape. The cylindrical portion 65*c* is equipped with a cylindrical surface 65*c*1 for sliding against the cylindrical hole 64. The cylindrical surface 65*c*1 is provided with a circumferential groove 65*c*2. Both ends of the cylindrical portion 65*c* are supported by the bearings 63. The shaft body 65*d* corresponds to the shaft body 33 of the lance nozzle 30 in the first embodiment, and therefore the detailed description thereof is omitted.

The flow path 67 is provided between the insertion portion 62 of the body 61 and the cylindrical hole 64. The flow path 67 opens into the circumferential groove 65*c*2 of the rotor 65. The flow path 68 is provided inside the rotor 65. The flow path 68 is of T-shape, which is composed of: a through-hole that has both ends opening into the circumferential groove 65*c*2; and a vertical hole that is provided along the center axis of the shaft body 65*d*. The flow path 67 and the flow path 68 communicate with each other through the circumferential groove 65*c*2. The circumferential groove 65*c*2 circumferentially evenly distributes the cleaning liquid supplied from the flow path 67, and continuously supplies cleaning liquid to the nozzle holes 35, 36 even if the rotational direction of the rotor 65 is changed. The nozzle holes 35, 36 communicates with the flow path 68. Furthermore, when the lance nozzle 60 is installed in the main spindle 51, the flow path 67 communicates with the flow path 55. The cleaning liquid supplied from the cleaning liquid supplying device 17 passes through the flow paths 55, 67, and 68 and is discharged as the jets J1 and J2 from the nozzle holes 35, 36. The third embodiment can also provide the operational advantage similar to the first embodiment.

The present invention is not to be understood limiting to the above-described three embodiments. The deformation and the combination of the above-described three embodiments may be performed to use. For example, the lance nozzle 60 of the third embodiment can be combined with the shield 41 of the second embodiment. Also, the main spindle head 52 of the excess sprayed coating removal device 50 of the third embodiment may be combined with the shield 41 of the second embodiment. Alternatively, the shield 41 of the second embodiment can be mounted on the end surface of the body 61 of the third embodiment. Furthermore, the shield 41 of the second embodiment may be combined with a linear guide and a moving device such as a cylinder to configure a shield into which the shield 41 can be inserted.

Note that, while in the above-described embodiments, the orthogonal three-axis type moving device is used for the move of the turret 11, instead of the moving device, a vertical articulated robot and a parallel link robot may be employed. Further, it is needless to say that the lance nozzle according to the present invention can be widely applied to the removal of adhered substances adhered on the inner surfaces of various structures other than the removal of the excess sprayed coating inside the cylinder block.

What is claimed is:

1. An apparatus comprising:

a multi-cylinder engine including a cylinder block with a plurality of cylinder bores and a crank chamber, the crank chamber being separated by a partition wall with a communication hole to form a plurality of small chambers; and a lance nozzle that injects fluid, the lance nozzle comprising:

a shaft body internally including a flow path of the fluid;

a first nozzle hole disposed on a leading end side of the shaft body, the first nozzle hole configured to generate a first jet in a first injecting direction, the first injecting direction being a direction inclining to a base end side of the shaft body with respect to a direction perpendicular to an axial direction of the shaft body; and a second nozzle hole disposed on a base end side of the first nozzle hole in the shaft body, the second nozzle hole configured to generate a second jet in a second injecting direction, the second injecting direction being a direction inclining to a leading end side of the shaft body with respect to a direction perpendicular to an axial direction of the shaft body, wherein:

the lance nozzle is configured to remove excess sprayed coating on the crank chamber of the cylinder block of the multi-chamber engine, the first nozzle hole has an inclination angle $\theta_1$ formed by the first injection direction and the axial direction of the shaft body satisfying a following formula 1, and the second nozzle hole has an inclination angle $\theta_2$ formed by the second injection direction and the axial direction of the shaft body satisfying a following formula 2:

$$\tan^{-1}\left(\frac{T}{2D}\right) \le \theta_1 < 90^\circ \quad \text{[Formula 1]}$$

$$0 < \theta_2 \le \tan^{-1}\left(\frac{T}{D}\right) \quad \text{[Formula 2]}$$

where

D: representative length of the communication hole; and

T: representative thickness of the partition wall.

2. The apparatus according to claim 1, wherein a distance L between the first nozzle hole and the second nozzle hole in the axial direction of the shaft body satisfies a following formula $$\frac{BP}{2\tan\theta_1} + \frac{BD}{2\tan\theta_2} - H \le L \le \frac{BD}{2\tan\theta_1} + \frac{BP - T}{2\tan\theta_2} + H - D \quad \text{[Formula 3]}$$

where

BP: distance of pitch between the cylinder bores;

BD: diameter of the cylinder bore;

$\theta_1$: angle formed by the first injection direction and the rotational axis of the shaft body;

$\theta_2$: angle formed by the second injection direction and the rotational axis of the shaft body;

T: representative thickness of the partition wall;

H: height from an upper end of the cylinder bore to an upper-side inner surface of the communication hole disposed on the partition wall in a case where the cylinder block is inverted; and D: representative length of the communication hole.

3. An apparatus comprising:

a multi-cylinder engine including a cylinder block with a plurality of cylinder bores and a crank chamber, the crank chamber being separated by a partition wall with a communication hole to form a plurality of small chambers;

a moving device;

a spindle casing;

a lance nozzle that injects fluid, the lance nozzle comprising:

a shaft body internally including a flow path of the fluid;

a first nozzle hole disposed on a leading end side of the shaft body, the first nozzle hole configured to generate a first jet in a first injecting direction, the first injecting direction being a direction inclining to a base end side of the shaft body with respect to a direction perpendicular to an axial direction of the shaft body; and a second nozzle hole disposed on a base end side of the first nozzle hole in the shaft body, the second nozzle hole configured to generate a second jet in a second injecting direction, the second injecting direction being a direction inclining to a leading end side of the shaft body with respect to a direction perpendicular to an axial direction of the shaft body, wherein:

the lance nozzle is configured to remove excess sprayed coating on the crank chamber of the cylinder block of the multi-chamber engine, the first nozzle hole has an inclination angle $\theta_1$ formed by the first injection direction and the axial direction of the shaft body satisfying a following formula 1, the second nozzle hole has an inclination angle $\theta_2$ formed by the second injection direction and the axial direction of the shaft body satisfying a following formula 2:

$$\tan^{-1}\left(\frac{T}{2D}\right) \leq \theta_1 < 90^\circ \quad \text{[Formula 1]}$$

$$0 < \theta_2 \leq \tan^{-1}\left(\frac{T}{D}\right) \quad \text{[Formula 2]}$$

where

D: representative length of the communication hole; and

T: representative thickness of the partition wall, the lance nozzle is arranged on the spindle casing, the lance nozzle configured to insert into the small chamber, such that the lance nozzle is inserted into the small chamber in a direction along an axial direction of the cylinder bore, and a shield having a block portion configured to intercept the first jet and the second jet, the shield configured to insert into the small chamber so as to face another cylinder bore different from one cylinder bore among the pair of the cylinder bores communicating with the small chamber, the shield configured to protect a sprayed coating on an inner surface of the other cylinder bore from the first jet and the second jet when the lance nozzle is inserted into the small chamber.

* * * * *